US011503963B2

(12) United States Patent
Lizotte

(10) Patent No.: US 11,503,963 B2
(45) Date of Patent: Nov. 22, 2022

(54) PORTABLE HYGIENE APPARATUS

(71) Applicant: Jason Eldon Lizotte, Grande Prairie (CA)

(72) Inventor: Jason Eldon Lizotte, Grande Prairie (CA)

( * ) Notice: Subject to any disclaimer, the term of this patent is extended or adjusted under 35 U.S.C. 154(b) by 86 days.

(21) Appl. No.: 16/884,144

(22) Filed: May 27, 2020

(65) Prior Publication Data

US 2021/0369055 A1 Dec. 2, 2021

(51) Int. Cl.
*A47K 1/02* (2006.01)
*E03C 1/182* (2006.01)

(52) U.S. Cl.
CPC ..... *A47K 1/02* (2013.01); *E03C 1/182* (2013.01)

(58) Field of Classification Search
CPC .... A47K 1/02; A47K 1/04; A47K 1/05; E03C 1/182
USPC ..... 4/516
See application file for complete search history.

(56) References Cited

U.S. PATENT DOCUMENTS 3,013,280 A * 12/1961 Coffman ..... A45D 19/04 4/516
3,041,957 A * 7/1962 Liptay ..... B01L 1/52 454/56
3,324,483 A * 6/1967 Conroy ..... E03C 1/182 248/146
4,765,003 A 8/1988 Chang
4,960,248 A 10/1990 Bauer et al.
4,998,302 A * 3/1991 Silva ..... A45D 19/04 4/516
5,305,481 A * 4/1994 Nebb ..... A45D 19/04 4/518
5,313,676 A * 5/1994 Wright ..... A47K 1/02 4/631
5,465,438 A * 11/1995 Allman ..... A47K 1/02 4/640
5,526,539 A 6/1996 Bower et al.
5,781,942 A 7/1998 Allen et al.
6,161,228 A * 12/2000 Wietecha ..... A47K 1/02 4/625
6,173,458 B1 * 1/2001 Maddux ..... A47K 1/02 4/619
7,730,561 B2 6/2010 Kostelyk
8,240,517 B1 8/2012 Stob et al.
8,707,983 B1 4/2014 Chen
9,526,380 B2 12/2016 Hamilton et al.
(Continued)

*Primary Examiner* — Benjamin R Shaw
(74) *Attorney, Agent, or Firm* — Orin Del Vecchio

(57) ABSTRACT

A portable hygiene station that is configured to be transportable so as to facilitate execution of hygiene protocols such as but not limited to hand washing at locations wherein utility infrastructure is unavailable. The portable hygiene station includes a frame wherein the frame is manufactured from a plurality of support members. The frame includes an upper portion and a lower portion that are integrally formed. The lower portion of the frame has mounted therein a first tank and a second tank. Mounted to a support shelf on the lower portion is a power supply and a pump that is electrically coupled to the power supply. The pump is configured to transfer fluid from the first tank into a basin member via a faucet member. Fluid from the basin member is subsequently transferred to the second tank. A top member provides coverage of the station and further has a photovoltaic panel.

8 Claims, 2 Drawing Sheets

(56) References Cited

U.S. PATENT DOCUMENTS

| | | | | |
|---|---|---|---|---|
| 10,271,691 | B1 * | 4/2019 | Boyle | A47K 1/02 |
| 2003/0234265 | A1 * | 12/2003 | Peck | A47K 1/02<br>222/608 |
| 2005/0086734 | A1 * | 4/2005 | Thies | A45D 19/04<br>4/516 |
| 2007/0186341 | A1 | 8/2007 | Uffner et al. | |
| 2007/0192953 | A1 * | 8/2007 | Hughes | A47K 1/02<br>4/625 |
| 2007/0256236 | A1 * | 11/2007 | Switzer | A47F 9/00<br>4/631 |
| 2010/0051639 | A1 * | 3/2010 | Stob | B60R 15/02<br>222/608 |
| 2012/0102638 | A1 * | 5/2012 | Al-Mahnna | A47K 1/02<br>4/626 |
| 2013/0212801 | A1 * | 8/2013 | Slayton | A47K 1/02<br>4/643 |
| 2017/0335561 | A1 * | 11/2017 | Wickramasekera | E04B 1/34363 |
| 2021/0321829 | A1 * | 10/2021 | Shell | A47K 1/02 |
| 2021/0395984 | A1 * | 12/2021 | Bickerton | A47K 1/02 |

* cited by examiner

PORTABLE HYGIENE APPARATUS

FIELD OF THE INVENTION

The present invention relates generally to hygiene apparatus, more specifically but not by way of limitation, a portable hygiene apparatus that can be transported to work sites and other locations wherein the apparatus includes the necessary elements to facilitate execution of certain hygiene routines such as but not limited to hand washing.

BACKGROUND

As is known in the art, job sites pose a unique challenge for workers during the construction phase. Depending upon the type of job site their may be a lack of utility infrastructure in the area such as when building a remote roadway or in the case of buildings, the utility infrastructure may not be present during certain phases of construction. Providing hygiene equipment and/facilities for the aforementioned environments can be challenging and as such they are typically not provided in embodiments that are either easy to use or sufficient.

While on job sites and in various construction sites, it is necessary for workers to occasionally cleanse their hands either as a result of a need to remove grease or other material. Additionally, it is considered good hygiene protocol to routinely wash hands to inhibit transmission of bacteria and other viruses. Without the presence of running water, the aforementioned is either not performed or materials such as but not limited to wipes and alcohol gels are utilized.

Accordingly, it is intended within the scope of the present invention to provide a portable hygiene apparatus that provides the ability to utilize water and surfactants wherein a user can perform hygiene protocols such as but not limited to hand washing at locations that do not have utility infrastructure.

SUMMARY OF THE INVENTION

It is the object of the present invention to provide a portable hygiene apparatus configured to be transported to various job sites wherein the present invention includes a frame having a plurality of support members.

Another object of the present invention is to provide a transportable apparatus that is configured to facilitate the delivery of various hygiene protocols such as but not limited to hand washing wherein the apparatus includes a first storage tank and a second storage tank.

A further object of the present invention is to provide a portable hygiene apparatus configured to be transported to various job sites wherein the present invention further includes a power supply secured to a portion of the frame.

Still another object of the present invention is to provide a transportable apparatus that is configured to facilitate the delivery of various hygiene protocols such as but not limited to hand washing wherein the apparatus further includes a pump and wherein the pump is electrically coupled to the power supply.

An additional object of the present invention is to provide a portable hygiene apparatus configured to be transported to various job sites that further includes a basin member wherein basin member includes an integrated faucet that is operably coupled to the pump.

Yet a further object of the present invention is to provide a transportable apparatus that is configured to facilitate the delivery of various hygiene protocols such as but not limited to hand washing wherein the frame includes an upper portion and a lower portion and wherein the upper portion includes a top member.

Another object of the present invention is to provide a portable hygiene apparatus configured to be transported to various job sites that further includes a photovoltaic panel wherein the photovoltaic panel is mounted to the top member of the upper portion of the frame and is further mounted on an extendable pole member.

Still a further object of the present invention is to provide a transportable apparatus that is configured to facilitate the delivery of various hygiene protocols such as but not limited to hand washing wherein the first storage tank is configured to receive water or an alternate cleaning fluid therein and the second storage tank receives the waste fluid from the basin member.

Yet another object of the present invention is to provide a portable hygiene apparatus configured to be transported to various job sites wherein the first storage tank further includes a heating element.

To the accomplishment of the above and related objects the present invention may be embodied in the form illustrated in the accompanying drawings. Attention is called to the fact that the drawings are illustrative only. Variations are contemplated as being a part of the present invention, limited only by the scope of the claims.

BRIEF DESCRIPTION OF THE DRAWINGS

A more complete understanding of the present invention may be had by reference to the following Detailed Description and appended claims when taken in conjunction with the accompanying Drawings wherein:

DETAILED DESCRIPTION

Figure 1:
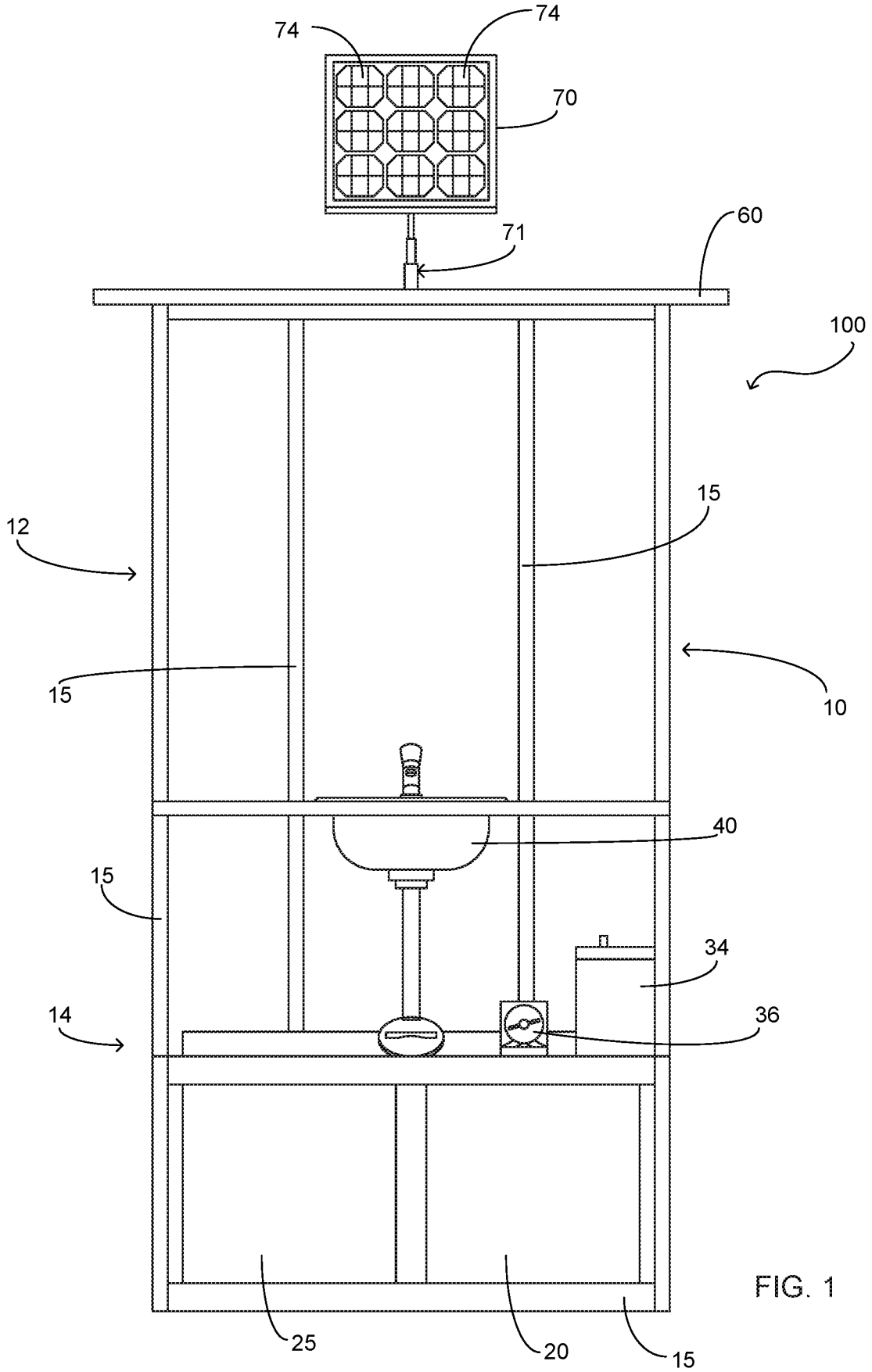
FIG. 1 is a front view of a preferred embodiment of the present invention.
Figure 2:
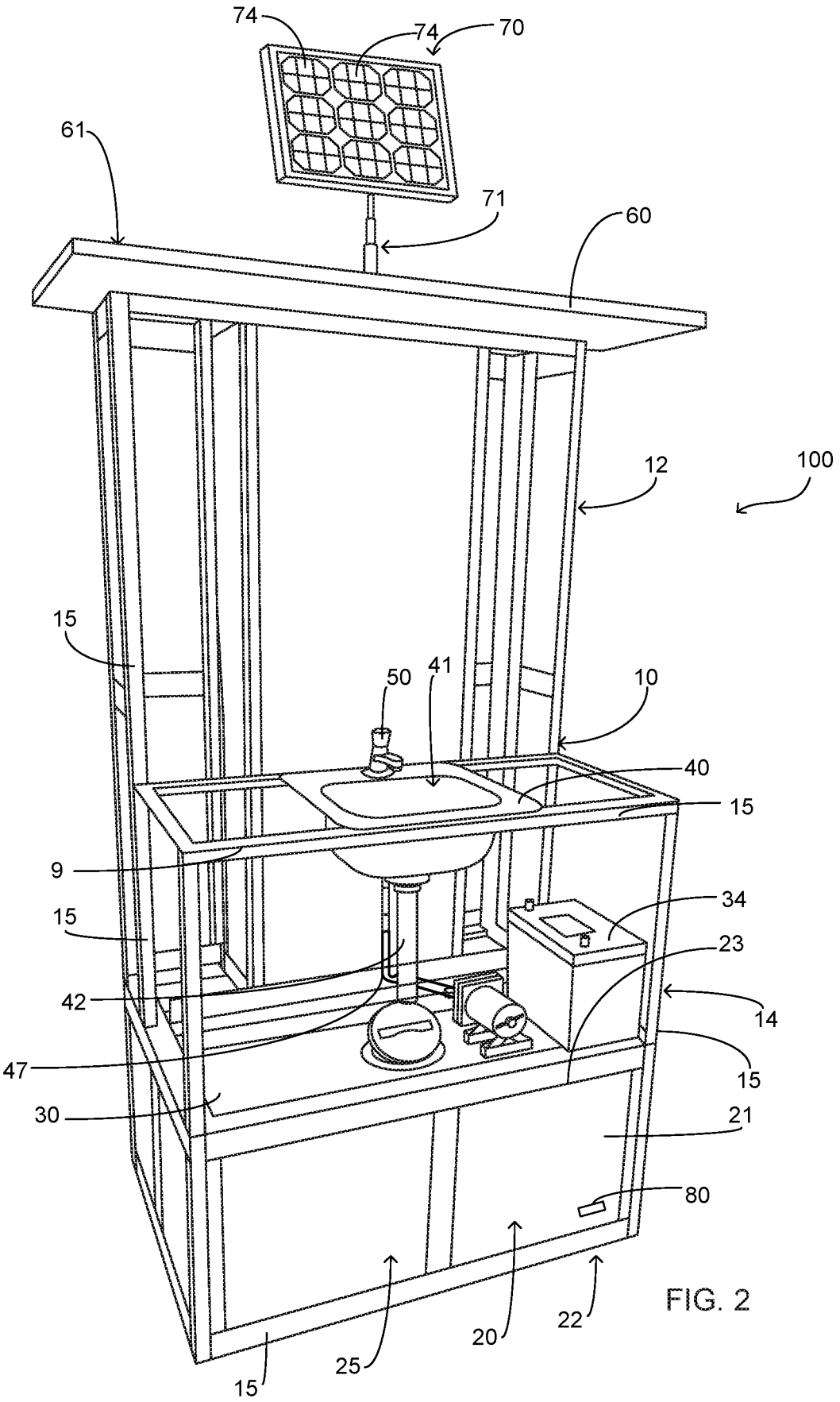
FIG. 2 is a front perspective view of the present invention.

Referring now to the drawings submitted herewith, wherein various elements depicted therein are not necessarily drawn to scale and wherein through the views and figures like elements are referenced with identical reference numerals, there is illustrated a portable hygiene apparatus 100 constructed according to the principles of the present invention.

An embodiment of the present invention is discussed herein with reference to the figures submitted herewith. Those skilled in the art will understand that the detailed description herein with respect to these figures is for explanatory purposes and that it is contemplated within the scope of the present invention that alternative embodiments are plausible. By way of example but not by way of limitation, those having skill in the art in light of the present teachings of the present invention will recognize a plurality of alternate and suitable approaches dependent upon the needs of the particular application to implement the functionality of any given detail described herein, beyond that of the particular implementation choices in the embodiment described herein. Various modifications and embodiments are within the scope of the present invention.

It is to be further understood that the present invention is not limited to the particular methodology, materials, uses and applications described herein, as these may vary. Furthermore, it is also to be understood that the terminology used herein is used for the purpose of describing particular embodiments only, and is not intended to limit the scope of the present invention. It must be noted that as used herein and in the claims, the singular forms "a", "an" and "the" include the plural reference unless the context clearly dictates otherwise. Thus, for example, a reference to "an element" is a reference to one or more elements and includes equivalents thereof known to those skilled in the art. All conjunctions used are to be understood in the most inclusive sense possible. Thus, the word "or" should be understood as having the definition of a logical "or" rather than that of a logical "exclusive or" unless the context clearly necessitates otherwise. Structures described herein are to be understood also to refer to functional equivalents of such structures. Language that may be construed to express approximation should be so understood unless the context clearly dictates otherwise.

References to "one embodiment", "an embodiment", "exemplary embodiments", and the like may indicate that the embodiment(s) of the invention so described may include a particular feature, structure or characteristic, but not every embodiment necessarily includes the particular feature, structure or characteristic.

Referring in particular to Figures herein, the portable hygiene apparatus 100 includes a frame 10. The frame 10 includes an upper portion 12 and a lower portion 14. The frame 10 in a preferred embodiment is manufactured from a plurality of support members 15 wherein the support members are operably coupled to form the desired shape and size of the frame 10. In a preferred embodiment the support member 15 are manufactured from square metal tubing and are assembled utilizing techniques such as but not limited to welding. While the frame 10 in the preferred embodiment is manufactured from metal , it is contemplated within the scope of the present invention that alternate materials and fastening techniques could be utilized to construct the frame 10. Furthermore, while the frame 10 is illustrated herein in a preferred embodiment, it is contemplated within the scope of the present invention that the frame 10 could be manufactured in alternate sizes and shapes. Additionally, it should be understood within the scope of the present invention that the frame 10 could be provided without the upper portion 12.

Mounted within the lower portion 14 of the frame 10 is the first tank 20. The first tank 20 is configured to receive and store water or other suitable cleaning fluid. The first tank 20 includes a plurality of walls 21, a bottom 22 and a top 23 forming an interior volume operable to retain a sufficient amount of fluid. While no particular size is required, it is contemplated within the scope of the present invention that the first tank 20 be configured to receive and retain twenty five gallons. The first tank 20 is manufactured from a suitable durable material such as but not limited to plastic. Adjacent to the first tank 20 is the second tank 25. The second tank is constructed identically to the first tank 20 and is operably coupled to the drain pipe 42 of the basin member 40 as is further discussed herein. The second tank 25 is configured to receive and retain the waste fluid egressing from the basin member 40 via the drain pipe. The fluid is retained in the second tank 25 and is stored therein for subsequent proper disposal. It should be understood within the scope of the present invention that the first tank 20 and second tank 25 could be any size or shape and further be mounted in any position within the frame 10.

Superposed a shelf member 30 are the power supply 34 and pump 36. The power supply 34 is a twelve volt power supply that is secured to the shelf member 30 utilizing suitable techniques such as but not limited to mounting brackets and fasteners. The power supply 34 is a direct current power supply and is electrically coupled to the pump 36. In a preferred embodiment of the present invention the power supply 34 is rechargeable and light weight. The pump 36 is fluidly coupled to the first tank 20 and is further fluidly coupled to the faucet member 50 via pipe 47. The pump 36 is a forward pressure style pump and is configured to activate when faucet member 50 is placed in an open position. This results in a loss of forward pressure and as such the pump 36 will activate into the on position and draw water from the first tank 20 and transfer to the faucet member 50. The pump 36 will move to its off position ensuing the faucet member 50 being placed in its closed position.

The basin member 40 is secured to the top 9 of the lower portion 14 of the frame 10. The basin member 40 is secured to the top 9 utilizing suitable durable techniques. The basin member 40 includes an interior volume 41 configured to provide an area suitable for placement of hands and other objects therein for cleansing. It should be understood within the scope of the present invention that the basin member 40 could be provided in alternate sizes and shapes. The basin member 40 has drain pipe 42 secured to the bottom thereof. The drain pipe 42 is configured to direct fluid from the interior volume 41 of the basin member 40 to the second tank 25 for storage thereof.

The upper portion 12 of the frame 10 extends vertically upward from the lower portion 14 and also is comprised of the support members 15. It should be understood within the scope of the present invention that the support members 15 could be arranged in various manners in order to create the desired size and shape of the upper portion 12. The upper portion 12 includes top member 60. Top member 60 is planar in manner and is configured to have a sufficient area so as to provide complete coverage of the lower portion 14 and further potentially a user engaged with the portable hygiene apparatus 100. It is contemplated within the scope of the present invention that the top member 60 while not illustrated herein could have secured thereto a paper towel dispenser of similar item.

Secured to the upper surface 61 of the top member 60 is a photovoltaic panel 70. The photovoltaic panel 70 includes a plurality of photovoltaic cells 74 and is electrically coupled to the power supply 34. The photovoltaic panel 70 is configured to provide charging of the power supply 34 when the portable hygiene apparatus 100 is deployed in a remote location. The photovoltaic panel 70 is mounted on a pole member 71 utilizing suitable durable techniques. In a preferred embodiment the pole member 71 is telescopic so as to provide the ability to extend the photovoltaic panel 70 upward. While a preferred embodiment of the pole member 71 is telescopic, it should be understood within the scope of the present invention that the pole member 71 could be manufactured of alternate lengths and non-telescopic construction.

Disposed in the first tank 20 is a heating element 80. The heating element is electrically coupled to the power supply 34 and is a low voltage electric heating element. The heating element 80 is operable to increase the temperature of the fluid disposed within the first tank 20. While one heating element 80 is illustrated herein, it is contemplated within the scope of the present invention that the portable hygiene apparatus 100 could employ more than one heating element 80 in the first tank 20.

In the preceding detailed description, reference has been made to the accompanying drawings that form a part hereof, and in which are shown by way of illustration specific embodiments in which the invention may be practiced.

These embodiments, and certain variants thereof, have been described in sufficient detail to enable those skilled in the art to practice the invention. It is to be understood that other suitable embodiments may be utilized and that logical changes may be made without departing from the spirit or scope of the invention. The description may omit certain information known to those skilled in the art. The preceding detailed description is, therefore, not intended to be limited to the specific forms set forth herein, but on the contrary, it is intended to cover such alternatives, modifications, and equivalents, as can be reasonably included within the spirit and scope of the appended claims.

What is claimed is:

1. A portable hygiene apparatus comprising:

a frame, said frame having a plurality of support members, said frame providing a structure to facilitate transportation of the portable hygiene apparatus;

a first tank, said first tank having an interior volume, said first tank having disposed therein a fluid;

a basin member, said basin member being mounted to said frame and said basin member further including a faucet member, said faucet member configured to control dispensing of the fluid into the basin member;

a second tank, said second tank being mounted to said frame, said second tank being operably coupled to said basin member via a drain pipe;

a pump, said pump being operably coupled to said first tank, said pump being configured to transfer the fluid disposed in said first tank to said basin member;

a power supply, said power supply being mounted to said frame, said power supply being electrically coupled to said pump and configured to provide operation thereof, and a photovoltaic panel, said photovoltaic panel being mounted to said top member, said photovoltaic panel being electrically coupled to said power supply, wherein said frame further includes an upper portion, said upper portion of said frame extending upward from an area adjacent to the basin member, said upper portion further including a top member, said top member operable to provide coverage of the basin member.

2. The portable hygiene apparatus as recited in claim 1, and further including at least one heating element, said at least one heating element electrically coupled to said power supply, said at least one heating element operable to increase a temperature of the fluid disposed within the first tank.

3. The portable hygiene apparatus as recited in claim 2, wherein the plurality of support members are metal.

4. A hygiene station that is constructed to provide portability thereof wherein the hygiene station comprises:

a frame, said frame having an upper portion and a lower portion, said upper portion and said lower portion of said frame being integrally formed, said upper portion and said lower portion of said frame being comprised from a plurality of support members, said lower portion of said frame having a shelf member, said lower portion of said frame having a top section;

a first tank, said first tank being mounted within said frame, said first tank having a plurality of walls, a bottom and top contiguously formed to create an interior volume, said first tank having disposed therein a fluid;

a second tank, said second tank being mounted within frame, said second tank having a plurality of walls, a bottom and top contiguously formed to create an interior volume;

a basin member, said basin member being mounted to said top of said lower portion of said frame, said basin member having an interior volume of suitable size to place a pair of human hands, said basin member being fluidly coupled to said first tank via a faucet member;

a pump, said pump being operably coupled to said first tank, said pump being configured to transfer the fluid disposed in said first tank to said basin member via said faucet member, said pump being operably coupled to said faucet member via a pipe; and a power supply, said power supply being mounted to said shelf member of said lower portion of said frame adjacent to said pump, said power supply being electrically coupled to said pump and configured to provide operation thereof, wherein said upper portion of said frame extends vertically from said lower portion, said upper portion of said frame further including a top member, said top member being planar in manner, said top member having a surface area sufficient to provide coverage of the hygiene station, and said top member has mounted to an upper surface thereof a photovoltaic panel, said photovoltaic panel having a plurality of photovoltaic cells, said photovoltaic panel being electrically coupled to said power supply.

5. The hygiene station as recited in claim 4, wherein said photovoltaic panel is operable mounted to a pole member, wherein said pole member is telescopic.

6. The hygiene station as recited in claim 5, wherein said first tank further includes at least one heating element, said at least one heating element being disposed within the interior volume of the first tank, said at least one heating element being operable to increase a temperature of the fluid disposed within the first tank.

7. The hygiene station as recited in claim 6, wherein the frame is provided in alternate sizes and shapes.

8. The hygiene station as recited in claim 7, wherein the plurality of support members of said frame are metal.

* * * * *